United States Patent [19]

Mueller

[11] Patent Number: 4,557,456

[45] Date of Patent: Dec. 10, 1985

[54] DEVICE FOR DETACHABLY FIXING OBJECTS

[76] Inventor: Christoph Mueller, Kleiner Muristalden 28, CH-3006 Bern, Switzerland

[21] Appl. No.: 454,510

[22] Filed: Dec. 29, 1982

[30] Foreign Application Priority Data

Dec. 30, 1981 [DE] Fed. Rep. of Germany ..... 3151964

[51] Int. Cl.[4] ..... A47B 96/06

[52] U.S. Cl. ..... 248/499; 248/220.3

[58] Field of Search ..... 248/499, 220.2, 220.3, 248/220.4, 221.1, 221.3, 221.4, 222.1, 222.2, 231, 346, 154, 187; 206/478, 479, 481; 24/619, 620; 411/508

[56] References Cited

U.S. PATENT DOCUMENTS

| | | | |
|---|---|---|---|
| 2,088,566 | 8/1937 | Avery | 248/615 |
| 3,575,288 | 4/1971 | Brucken | 248/615 |
| 3,650,502 | 3/1972 | Langhi | 248/220.4 |
| 4,094,487 | 6/1978 | Heard | 248/231 |
| 4,249,716 | 2/1981 | Barron | 248/231 |
| 4,309,263 | 1/1982 | Boyd | 248/231 |

FOREIGN PATENT DOCUMENTS

| | | |
|---|---|---|
| 1796977 | 5/1959 | Fed. Rep. of Germany . |
| 7931149 | 2/1980 | Fed. Rep. of Germany . |
| 1086173 | 4/1964 | United Kingdom . |

*Primary Examiner*—Ramon S. Britts
*Assistant Examiner*—Ramon O. Ramirez
*Attorney, Agent, or Firm*—Barnes & Thornburg

[57] ABSTRACT

This invention relates to a device for detachably fixing objects differing in size to a perforated plate. The objects differing in size should be reliably and detachably mounted on the perforated plate so that they are firmly, but not too firmly secured to the plate. For this purpose, two retaining plates are provided, which are adapted to be mounted on the perforated plate, and a rubber ring disposed between said retaining plates is adapted to be stretched over the object which is to be fixed. In order to permit a further subdivision of the hole spacing of the perforated plate, at least one bracket is provided, which is L-shaped in side elevation and in which the arm which faces the perforated plate has an end portion which is angled preferably through 90° and is adapted to be selectively inserted into one of at least two spaced apart grooves or recesses formed on the underside of the retaining plate. The spacing of said grooves is a fraction of the hole spacing of the perforated plate. A cushion is adapted to be fixed to the protruding arm of at least one of the brackets so that the groove spacing can be further subdivided.

17 Claims, 4 Drawing Figures

DEVICE FOR DETACHABLY FIXING OBJECTS

BACKGROUND OF THE INVENTION

This invention relates to a device for detachably fixing objects differing in size to a perforated plate.

Various objects can be mounted on a perforated plate so that the objects are clearly arranged and can readily be taken. The objects may consist, e.g., of different tools or instruments used in a workshop or laboratory, or a tool bag or a case for photographic equipment may be provided on its rear wall with a properly dimensioned perforated plate for carrying a set of tools, instruments or items for photographic purposes.

The object to be fixed may be exponsive and susceptible to pressure and must be mounted on the perforated plate reliably and securely but owing to their susceptibility must not be excessively stressed. These objects themselves usually have no retaining means such as hooks or eyes but each object has associated with it a special holder, which fits the object to be mounted and can be detachably secured to the perforated plate by connecting means, particularly by one or more plug pins.

A disadvantage of that arrangement resides in that each of the objects to be fixed requires a separate holder, which conforms to the object.

SUMMARY OF THE INVENTION

For this reason it is an object of the invention to provide a holding device for detachably fixing objects differing in size to a perforated plate so that one and the same device can be used to reliably secure objects differing in size to the perforated plate firmly, but not too firmly.

The means for accomplishing said object are stated in the main claim and further developments are recited in the dependent claims.

Two retaining plates are provided, which are adapted to be secured to the perforated plate in spaced apart relation. A rubber ring disposed between the two retaining plates is adapted to be stretched over the object that is to be fixed.

The fact that the distance between the retaining plates can be changed in steps depending on the hole spacing of the perforated plate permits a first adaptation to the size of the object to be fixed. A further adaptation is permitted by the elasticity of the rubber ring, which can be stretched more or less tightly. But this adaptation will be limited if delicate objects are to be fixed. It is favorable that the compliance of the rubber ring results in an absorption of shocks. Besides, rubber rings differing in size may be used for different objects.

To permit an even finer adjustment of the device to the size and nature of each object to be held, particularly with delicate objects, i.e., to permit a further subdivision of the hole spacing of the perforated plate, the invention provides at least one L-shaped bracket, which has at least one arm that faces the perforated plate and has an end portion that is angled preferably through 90° and is adapted to be selectively inserted into one of at least two grooves or recesses formed on the underside of at least one of the two retaining plates and having a spacing which is a fraction of the hole spacing of the perforated plate. The hole spacing of the perforated plate will then be bisected if two such grooves are provided or will be tresected if three grooves are provided.

Cushions may be slipped on the retaining plates to provide additional safety. A cushioning and an adjustment of the fixing device to the size of an object to be fixed will be permitted with the aid of very simple means if a cushion having lateral grooves is adapted to be fitted on the protruding arm of the bracket with the aid of said lateral grooves. Depending on which of the two boardsides of the cushion faces the object to be held, a larger or smaller part of the total thickness of the cushion will be effective.

The utility of such device will be further increased if at least one of the two brackets is provided with an eye or a reversely bent end portion for captively holding the rubber ring.

DETAILED DESCRIPTION OF THE PREFERRED EMBODIMENT

Figure 1:
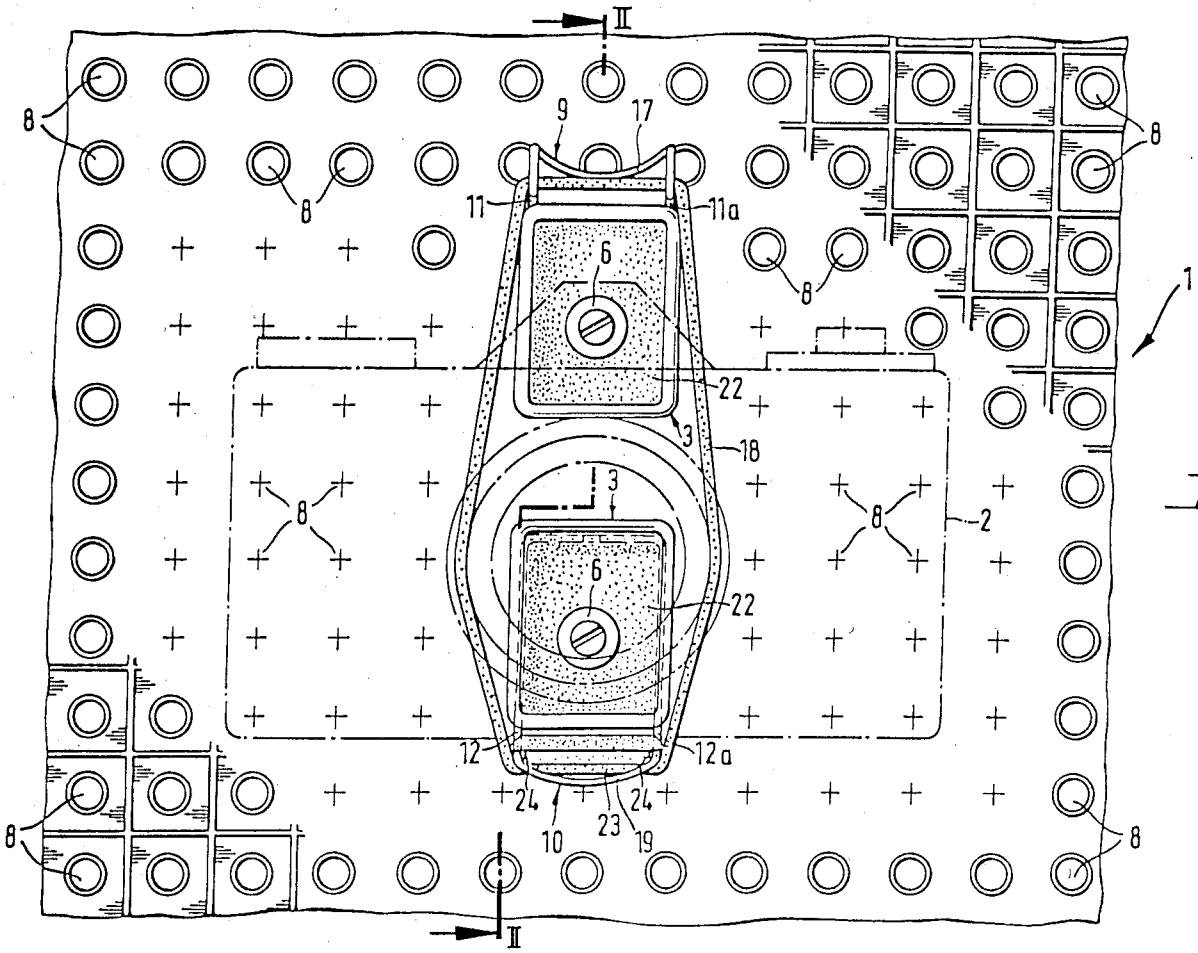
FIG. 1 is a top plan view showing an illustrative embodiment of the invention.

An illustrative embodiment of the invention will now be described with reference to the drawings.

Any one of the plurality of objects is to be detachably secured to a perforated plate by one and the same holding device. In the example shown, a photographic camera 2 indicated in phantom is secured to a portion of the perforated plate 1. Other items of photographic equipment may be secured beside the camera 2 to the same perforated plate 1. All these objects differing in size are secured to the perforated plate with identical fixing devices according to the invention. That device will now be described with reference to the drawing. Each fixing device comprises two retaining plates 3, which are preferably identical. Each retaining plate 3 has a hole 4, through which a special plug pin 5 extends, which is known per se and has a head 6 which engages the retaining plate at the rim defining the hole 4 whereas the other end of the pin 5 is provided with a projection or eccentric 7, which engages the perforated plate 1 at the rim of a hole 8 of the plate 1. In this manner the retaining plate 3 is secured to the perforated plate and can be secured to any desired hole 8 of the perforated plate, so that the two retaining plates 3 can be secured to the perforated plate with a spacing which can be adjusted in steps from hole to hole of the perforated plate.

An L-shaped bracket 9, 10 consisting preferably of wire is secured to each of the two retaining plates and is clamped between the retaining plate 3 and the perforated plate 1. The brackets 9, 10 might be infinitely adjusted relative to the retaining plate and clamped in their adjusted positions but this would not be sufficiently reliable. For this reason the brackets 9, 10 are adjustable relative to the retaining plate 3 in steps and held in each adjusted position against an unintended displacement.

Figure 2:
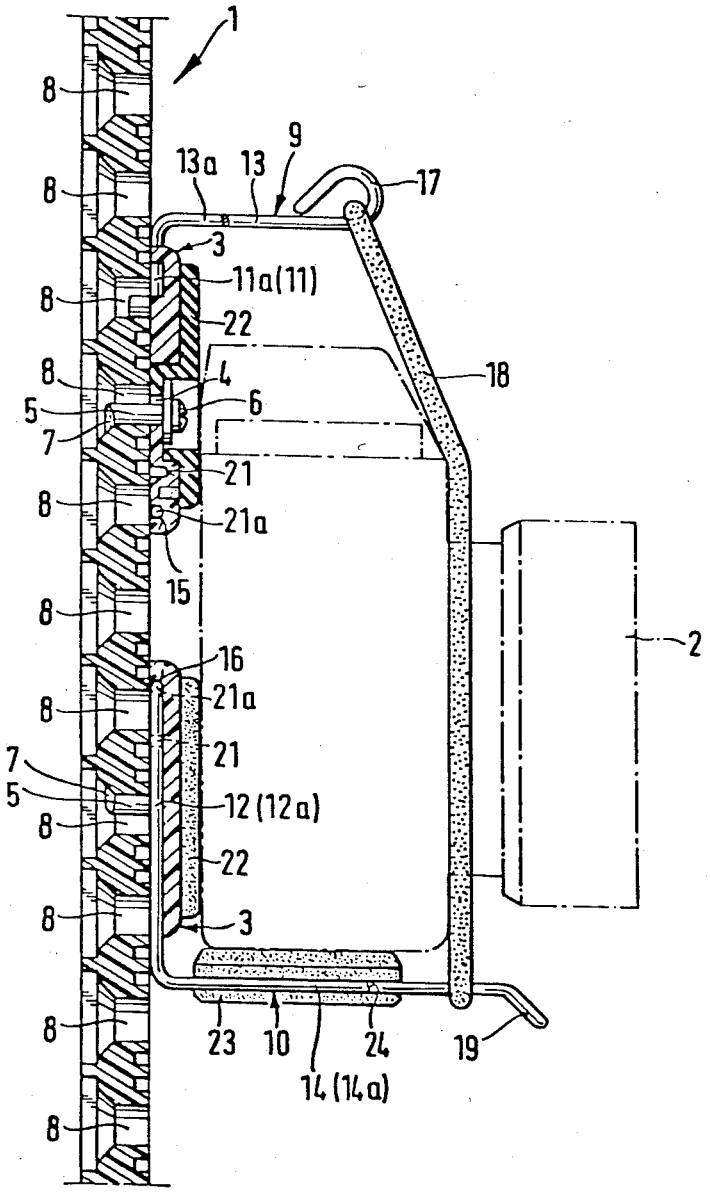
FIG. 2 is a sectional view taken on line II—II of FIG. 1.
Figure 3:
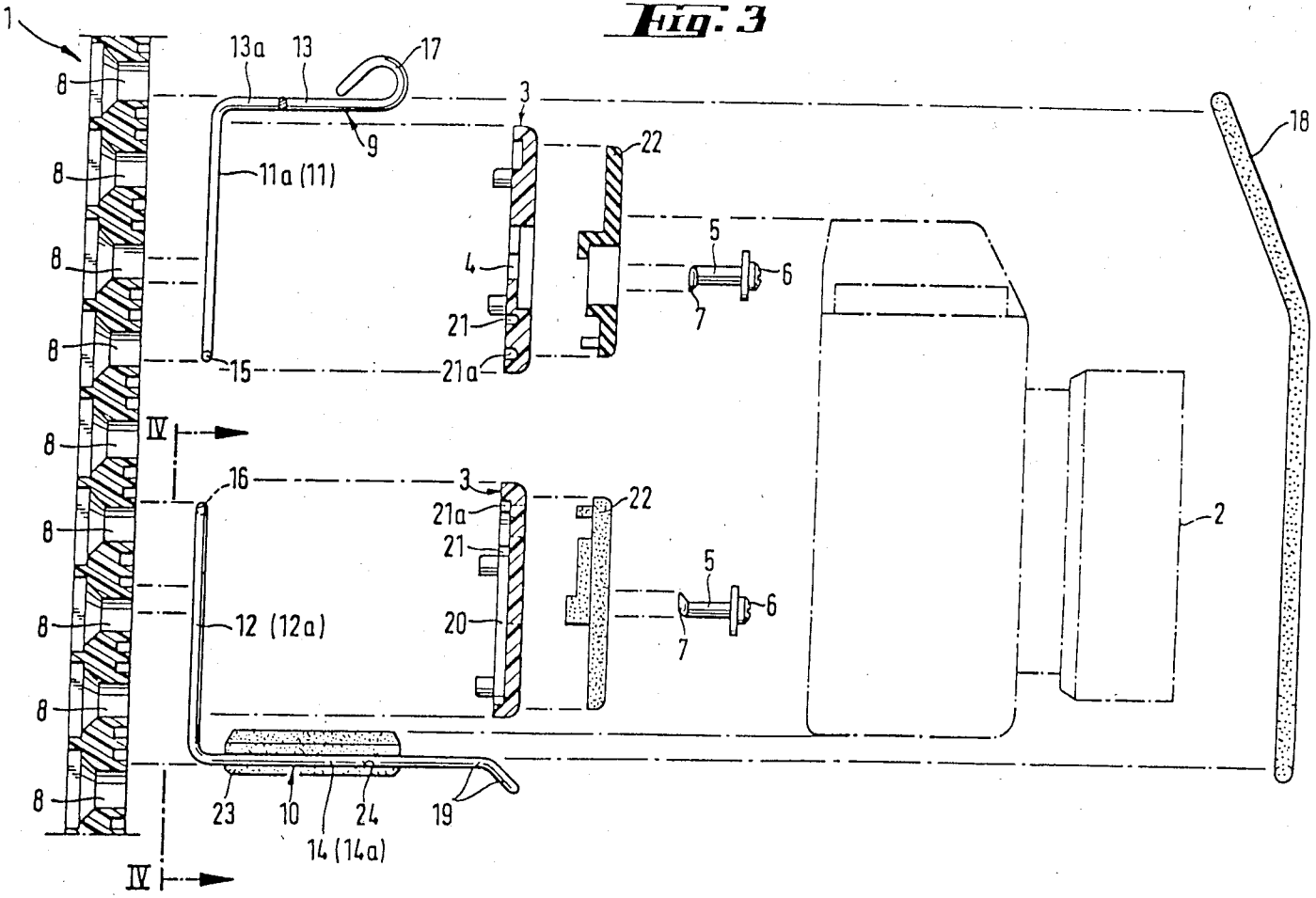
FIG. 3 is an exploded view showing the parts of FIG. 2.

When viewed in side elevation as shown in FIGS. 2, 3, each bracket 9 has an arm 11 or 12 which contacts the perforated plate 1 and an arm 13 or 14 which protrudes at right angles from the perforated plate 1. The arm 11 or 12 which contacts the perforated plate 1 has an end portion 15 or 16 which is angled through 90°.

Figure 4:
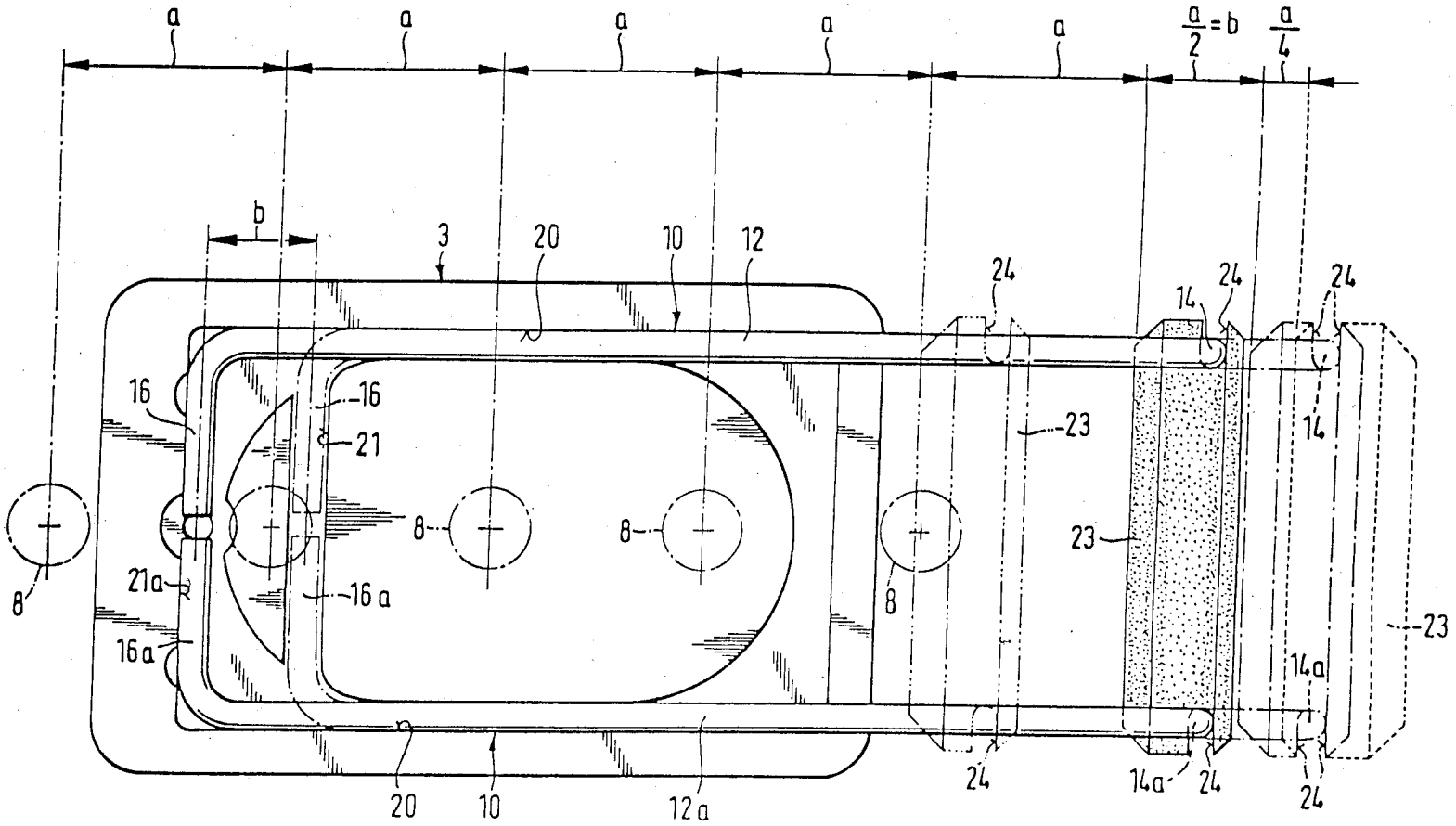
FIG. 4 is an enlarged view taken from below in the direction of the arrow IV in FIG. 3 and showing one of the two retaining plates and the bracket.

Upon a comparison of FIGS. 2, 3, 4 it is apparent that each bracket 9 or 10 has been formed by bending an integral length of wire or the like and comprises two parallel arms 12, 12*a* or 11, 11*a*, which engage the perforated plate 1, and arms 13, 13*a* or 14, 14*a*, which protrude from the perforated plate. Those arms 13, 13*a* or 14, 14*a* of each bracket which protrude from the perforated plate are connected by a crosspiece. The crosspiece of the bracket 9 is bent to form an eye 17 which just permits the rubber ring 18 to be inserted into the eye 17 but ensures that the rubber ring 18 will not inadvertently have the eye. The rubber ring is stretched over the object 2 and at its other end has snapped behind the angled crosspiece 19 at the end of the protruding arms 14, 14*a* of the other bracket 10.

As has been mentioned hereinbefore the retaining plates 3 can be adjusted from hole to hole of the perforated plate to obtain the desired spacing of the retaining plates 3. For this reason the hole spacing a of the perforated plate may be further divided in accordance with the invention as is particularly apparent from FIG. 4, where the two arms 12, 12*a* of the bracket 10 which contact the perforated plate 1 are inserted in respective longitudinal grooves 20, which are laterally provided on the retaining plate 3. The angled end portion 16, 16*a* of the bracket 10 can be selectively inserted into one of two recesses or grooves 21, 21*a*, which are formed on the spaced underside of each retaining plate 3 and are spaced apart by a distance b, which is one-half of the hole spacing a.

A cushion 22 is mounted on each retaining plate 3 and preferably has been slipped thereon and is adapted to be engaged by the camera 2 or other object. A special cushion 23 is fitted on the protruding arms 14, 14*a* of one bracket 10 by means of eccentric grooves 24 formed in the cushion 23. In the example shown, the major portion of the thickness of the cushion is effective between the camera 2 and the bracket. But the cushion 23 can alternatively be secured in an inverted position so that the smaller part of its thickness engages the camera or other object. In this manner the spacing b of the grooves 21, 21*a* of the retaining plates 3 can be further subdivided for an even finer adaptation of the fixing device.

What is claimed is:

1. A device for detachably fixing objects differing in size to a perforated plate, comprising two or more retaining plates (3), which are adapted to be secured to the perforated plate (1) in spaced apart relation, characterized in that a rubber ring (18) disposed between the retaining plates (3) is adapted to be stretched over the object (2) to be fixed, and at least one of the retaining plates (3) is provided with a bracket (9, 10), which is L-shaped in side elevation and has one arm (11, 12) having an end portion (15, 16) which is angled preferably through 90° and adapted to be selectively inserted into one of at least two recesses formed on the underside of the retaining plates (3).

2. A device according to claim 1, characterized by the provision of a cushion (23), which is adapted to be fitted on a protruding portion (13, 14) of the bracket by means of eccentric lateral grooves (24) of the cushion.

3. A device according to at least one of claims 1 or 2, characterized in that at least one cushion (22) is adapted to be slipped on each of the retaining plates (3).

4. A device according to claim 1, characterized in that at least one of the two brackets (9) comprises an eye (17) or a reversely bent end portion for captively holding the rubber ring (18).

5. A device according to claim 2, characterized in that at least one of the two brackets (9) comprises an eye (17) or a reversely bent end portion for captively holding the rubber ring (18).

6. A device according to claim 3, characterized in that at least one of the two brackets (9) comprises an eye (17) or a reversely bent end portion for captively holding the rubber ring (18).

7. Apparatus for detachably securing an object to a perforated plate, comprising: elastic means for securing an object; bracket means for attaching the elastic means to a perforated plate; retaining means, adapted to be attached to said perforated plate through an aperture of said perforated plate, for securing said bracket means to said perforated plate, said retaining means having a surface which engages said bracket means; and means on said retaining means for laterally adjusting said bracket means relative to said retaining means.

8. Apparatus according to claim 7, wherein said retaining means includes a plurality of recesses on said surface which engage said bracket means.

9. Apparatus according to claim 7, further comprising a cushion disposed on a second surface of said retaining means.

10. Apparatus according to claim 7, wherein said bracket means includes a generally L-shaped bracket member having an arm disposed adjacent to said perforated plate, and wherein said recesses engage said arm to allow for lateral adjustment of said L-shaped bracket member relative to said retaining means.

11. Apparatus according to claim 10, further comprising a cushion disposed on a second arm of said bracket member, said second arm extending in a generally vertical direction from the surface of said perforated plate.

12. A device for detachably fixing objects differing to size to a perforated plate comprising a perforated plate (1) having apertures at set spacing (a), and two or more retaining plates (3) which are adapted to be secured to said perforated plate (1) in spaced apart relation, characterized in that a rubber ring (18), disposed between said retaining plates (3), is adapted to be stretched over the object (2) to be fixed, and at least one of said retaining plates (3) is provided with a bracket (9, 10) which is L-shaped in side elevation and has one arm (11, 12) having an end portion (15, 16) which is angled preferably through 90° and adapted to be selectively inserted into one of a plurality of recesses (21, 21*a*) formed on the underside of said retaining plates (3), said recesses (21, 21*a*) having a spacing (b) equal to the quotient of the aperture spacing (a) of said perforated plate (1) and the number of recesses.

13. A device according to claim 12, characterized by the provision of a cushion (23), which is adapted to be fitted on a protruding portion (13, 14) of the bracket by means of eccentric lateral grooves (24) of the cushion.

14. A device according to at least one of the claims 12 or 13, characterized in that at least one cushion (22) is adapted to be slipped on each of the retaining plates (3).

15. A device according to claim 12, characterized in that at least one of the two brackets (9) comprises an eye (17) or a reversely bent end portion for captively holding the rubber ring (18).

16. A device according to claim 13, characterized in that at least one of the two brackets (9) comprises an eye (17) or a reversely bent end portion for captively holding the rubber ring (18).

17. A device according to claim 14, characterized in that at least one of the two brackets (9) comprises an eye (17) or a reversely bent end portion for captively holding the rubber ring (18).

* * * * *